United States Patent [19]

Armstrong

[11] 4,163,550

[45] Aug. 7, 1979

[54] PRESSURE ROLLER ASSEMBLY

[75] Inventor: Joel D. Armstrong, Antioch, Ill.

[73] Assignee: AM International, Inc., Los Angeles, Calif.

[21] Appl. No.: 823,435

[22] Filed: Aug. 10, 1977

[51] Int. Cl.[2] ..... B65H 5/06

[52] U.S. Cl. ..... 271/274; 198/836; 226/187

[58] Field of Search ..... 271/274, 273, 251; 226/177, 176, 187; 198/836

[56] References Cited

U.S. PATENT DOCUMENTS

| | | | |
|---|---|---|---|
| 1,299,386 | 4/1919 | Schreck | 271/274 |
| 3,741,536 | 6/1973 | Anderson | 271/274 |
| 3,951,402 | 4/1976 | Skinner | 271/273 |

*Primary Examiner*—Bruce H. Stoner, Jr.

*Attorney, Agent, or Firm*—George Jameson; Michael A. Kondzella; Russell L. Root

[57] ABSTRACT

A pressure roll assembly for applying pressure forces to sheet material articles being driven by a conveyor. A pressure roll is mounted for rotation about a central axis. A longitudinally extending leaf spring has a first portion which supports the pressure roll for rotation about its central axis, and a longitudinally spaced second portion which is fixedly connected with a support member so that the leaf spring supports the pressure roll in a cantilevered condition. An axially extending shaft is disposed normal to the longitudinal axis of the leaf spring and is fixed to the support member. Means are provided for guiding the shaft for axial movement and for restraining movement of the shaft transverse to its axis. Means are further provided for adjusting the axial position of the shaft for adjusting the pressure in the nip between the pressure roll and the conveyor surface.

2 Claims, 4 Drawing Figures

PRESSURE ROLLER ASSEMBLY

BACKGROUND OF THE INVENTION

This application relates to a pressure roll assembly for applying pressure to sheet material articles being driven by a belt conveyor. It relates particularly to a pressure roll assembly which is designed to precisely control the pressure on the sheet material articles, in order to apply enough pressure to hold the sheet material articles on the conveyor, and yet to eliminate or substantially reduce noticeable ink tracking on sheet material articles having freshly printed ink on their upward facing sides.

In the sheet handling arts there are various instances in which sheet material articles are driven by means of a conveyor which is formed by one or more moving belts. In such systems it is often desirable to provide a pressure roll assembly forming a nip with the belt conveyor. The pressure roll assembly functions to apply pressure forces to the sheet material articles to maintain positive engagement of the sheet material articles with the conveyor belts, in order to assure precise driving of the sheet material articles by the belts.

One type of known prior art pressure roll assembly includes a longitudinally extending support rod disposed in fixed relation above and longitudinally with respect to the belt conveyor and a rockable support shaft extending transversely to the support rod. One end of a leaf spring is connected with the support shaft, and the other end of the leaf spring journals a rotatable pressure roll whose axis of rotation is parallel to the rotatable axle. The pressure roll is freely rotatable about its axis and includes a knurled outer surface. A releasable clamp fixes the position of the support shaft relative to the support rod as well as its angle of rock. In order to adjust the pressure in the nip between the roll and the belt it is necessary to release the clamp and manually rock the rotatable axle to the desired position. The clamp is then engaged to lock the roll in the adjusted position.

Another apparatus for applying pressure to sheet material articles is illustrated in U.S. Pat. No. 3,741,536. This patent illustrates a support disposed above the conveyor belts, and the support includes means for freely supporting a series of balls. An adjustment screw arrangement is connected with the ball support and is designed to adjust the position of the ball support above the conveyor.

There are various instances in the sheet handling art in which precise and fine adjustment of the tension in the nip between the pressure roll and the conveyor belts is required. One circumstance which requires precise adjustment occurs when sheets having freshly printed material are fed onto the conveyor in a "face up" condition. This situation may occur in sheet duplicating mechanisms. When sheets are fed in a "face up" condition an imprecisely tensioned roller may pick up ink and deposit it on areas of the sheets. This condition is known to those in the art as tracking. The system of U.S. Pat. No. 3,741,536 is not as capable of reducing or minimizing tracking as the present invention, because of the fact that the balls have smooth surfaces (which in itself tends to pick up substantial ink). In addition, with heavy (thick) sheet material articles, the balls may bounce considerably when they are engaged by the sheet stock and hence fail to feed the sheet reliably. Mainly, however, precise adjustment of pressure is not possible because the weight of the balls is fixed, and the balls are essentially resting with their full weight on the sheet or else are raised so as to have zero or nominal sheet contact.

In pressure roll assemblies which employ a rockable support shaft which is manually rocked to set the roll pressure, it is very difficult to precisely adjust the pressure of the roll. While a knurled roll surface, per se, may produce less tracking than a spherical ball surface, the imprecision in obtaining fine adjustment of this mechanism makes it very difficult to avoid tracking problems.

Another reason requiring very precise control of the pressure in the nip between the roll and the belt occurs when the thickness of the stock being driven by the conveyor varies. Heavy, thick, stock can result in considerable bouncing of the balls in the system of U.S. Pat. No. 3,741,536.

Another prior art pressure roll construction is illustrated in U.S. Pat. No. 1,299,386. According to this disclosure a pressure roll or roller is supported at the end of a curved spring member which is fixedly connected to a fixed support. Movement of the roller to adjust pressure is provided by movement of a screw which engages the curved spring member adjacent the roller, so that the roller pressure setting is essentially a direct function of the roller position as determined by the screw setting.

SUMMARY OF THE INVENTION

The present invention relates to a pressure roll construction which is simple in construction, and yet which has been found to be capable of exerting an extremely precisely controllable pressure force on sheet material articles being driven by a conveyor. The invention provides a pressure roll construction which is believed to be capable of substantially reducing, and in most cases eliminating, noticeable tracking on sheet material articles fed in a "face up" condition.

The invention includes a pressure roll construction in which the pressure roll or roller is mounted for rotation about a central axis. A longitudinally extending leaf spring has a first portion which supports the pressure roll for rotation about its central axis, and a longitudinally spaced second portion which is fixedly connected with a support member or plate so that the leaf spring is cantilevered from the support plate. A support post is disposed normal to the longitudinal axis of the leaf spring, is fixed to the support member, and is thus rigidly connected with the end of the leaf spring. Means are provided for guiding the post for axial adjusting movement and for restraining movement of the post or any portion thereof transversely of its axis. Means are further provided for adjusting the axial position of the post in a gradual manner, preferably by screw threads.

The pressure roll preferably includes a knurled surface which is a further feature designed to reduce potential tracking problems. In the preferred form of the invention the leaf spring is a longitudinally extending planar member having a one end rigidly connected to a flat surface of the support plate, and the distal end rotatably supporting the pressure roll. The support post is disposed normal to the support plate and rigidly secured thereto. The post extends through a bore in a guide block and is guided thereby for axial movement while being constrained against movement transverse to its axis. Spring means acts between the guide block and the support member and biases the guide block against a fixed support. An adjustment member is rotatable about the axis of the shaft and includes an axially extending threaded portion which is engageable with a threaded bore in the shaft, so that rotation of the adjustment member rotates the threaded portion for axially positioning the shaft for adjusting the tension in the nip between the roll and the conveyor surface.

As is later explained in detail, the effect of this arrangement is to provide the pressure roll with spring biasing effect of a character which has extremely small force change per unit of deflection, and which thereby allows extremely accurate setting of the roll pressure. Also included as part of the invention is means for manually controlling the spring deflection which is of a character permitting the setting to be easily made during sheet feeding operation of the roll so that the effect of the setting can be viewed simultaneously with its being made in order to allow for accurate control.

BRIEF DESCRIPTION OF THE DRAWINGS

The further features and advantages of this invention will become further apparent from the following detailed description taken with reference to the accompanying drawings wherein.

DETAILED DESCRIPTION OF THE PREFERRED EMBODIMENT

Figure 1:
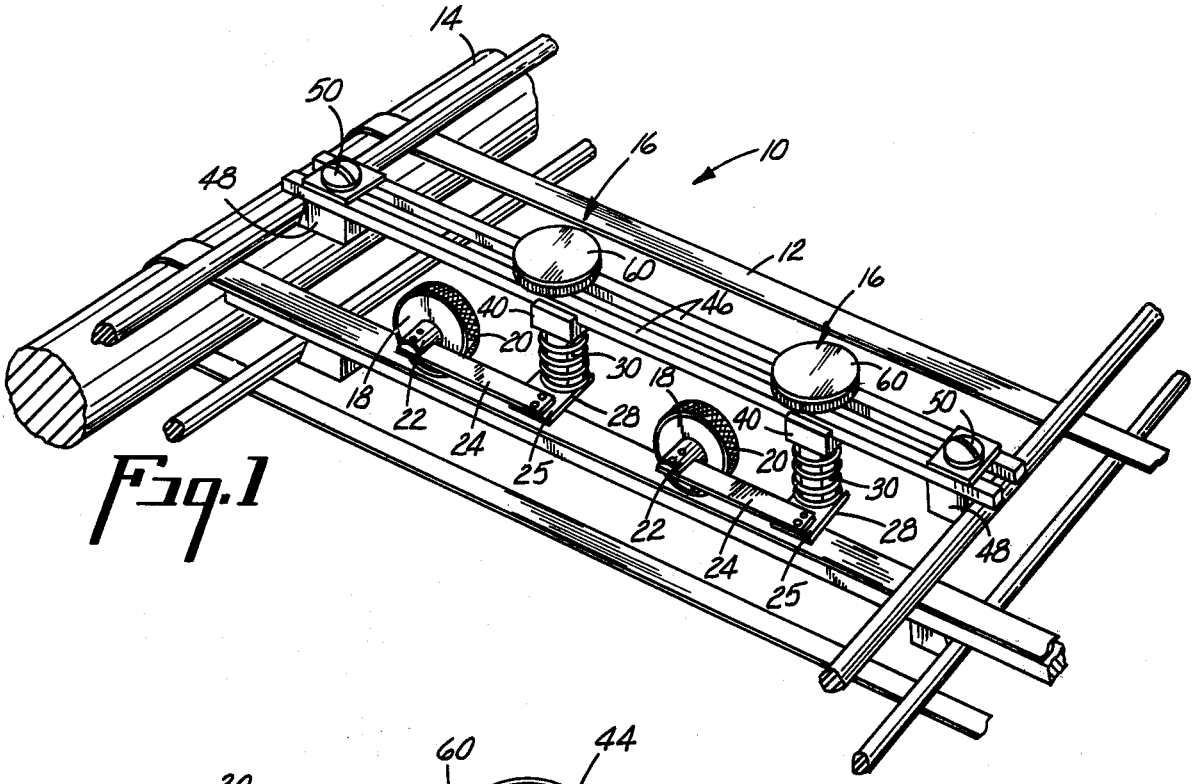
FIG. 1 is a perspective view of a portion of a sheet handling apparatus including the pressure roll construction according to the present invention.
Figure 2:
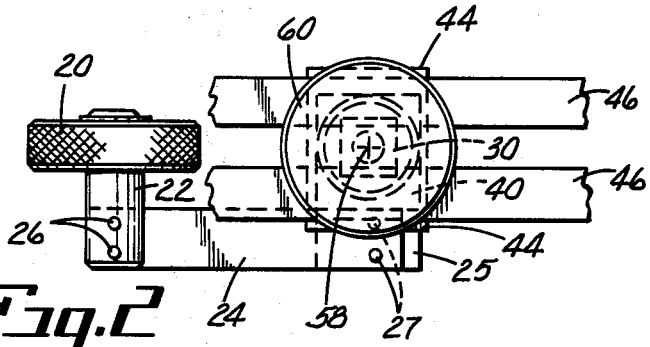
FIG. 2 is a top view of a portion of the apparatus of FIG. 1, and illustrating the pressure roll assembly according to the invention.
Figure 3:
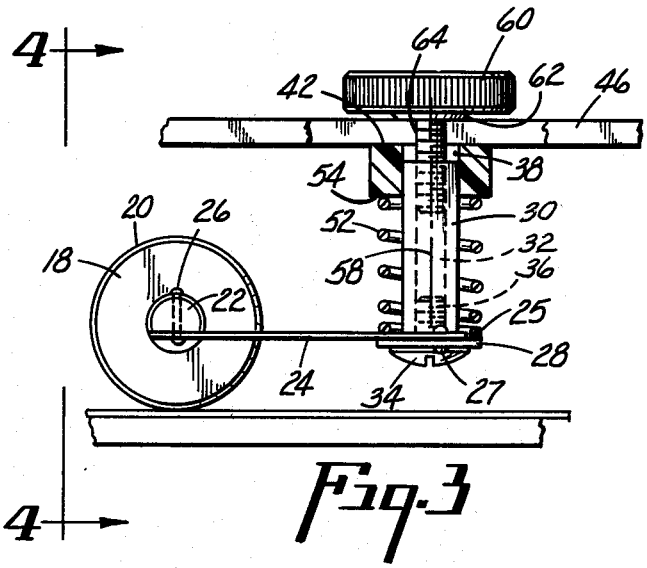
FIG. 3 is a side view with parts broken away and partly in section, of the pressure roll assembly according to the invention.
Figure 4:
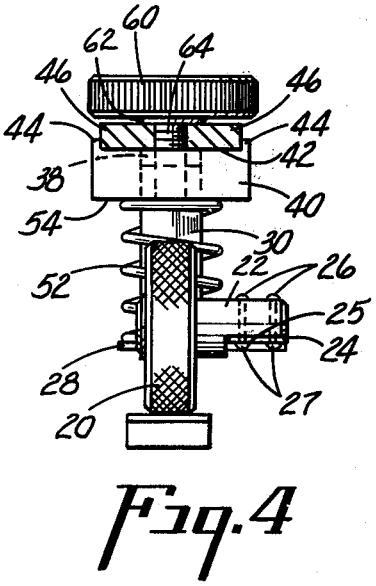
FIG. 4 is a front view of a pressure roll assembly according to the invention, taken from the direction 4—4 in FIG. 3.

The pressure roll assembly constructed according to the principals of this inventions is shown in perspective in FIG. 1 in connection with a conveyor 10. The conveyor includes a plurality of conveyor belts 12 entrained about appropriate rollers (one roller 14 is illustrated) and designed to engage sheet material articles to drive the sheet material articles along a predetermined path.

The conveyor 10 could form part of the sheet receiving portion of a duplicator. Sheets printed in the duplicator would be delivered to the conveyor 10 and would be driven thereby into engagement with a conventional register stop (not shown). The sheet material articles may be jogged laterally in order to correctly position their edges in alignment with each other as they register against the stop.

A pair of pressure roll assemblies 16 constructed according to the principles of the present invention are illustrated in FIG. 1. Each pressure roll assembly includes a pressure roll or roller 18 having a cylindrical outer surface 20 which forms a nip with a moving belt 12. The outer surface 20 preferably has a knurled construction formed by a series of criss-crossing grooves indented relating to the otherwise cylindrical outer surface.

The pressure roll 18 is freely rotatable about an axle 22 which extends transversely to the upper surface of the belt 12. The axle 22 is fixedly connected to one end of a substantially flat planar leaf spring 24 by rivets 26.

The other end of leaf spring 24 is fixedly connected to the substantially flat upper surface 25 of a support member or plate 28 as by rivets 27. The leaf spring 24 and the roll 18 are supported in cantilever-like fashion from the support member 28.

A support post or shaft 30 extends normal to surface 25 of the support member. Shaft or post 30 is preferably square in cross section, and includes a threaded bore 32 extending axially therethrough. One end of shaft 30 is fixedly connected with support member 28 by means of a locking screw 34 having a threaded portion 36 which extends through a suitable opening in the support member 28 and into the threaded bore 32 in the shaft 30.

The square post 30 extends through a square passage 38 in a guide block 40. Guide block 40 includes a flat upper surface 42 and a pair of flanges 44 which extend upward therefrom. A pair of parallel support or guide rods 46 are fixedly supported above the conveyor belts 12 in substantially parallel relation thereto. The ends of the rods 46 are engaged by clamping blocks 48 and locking screws 50, and are thereby mounted upon portions of the machine structure in a known manner.

The upwardly extending flanges 44 of the guide block 40 are disposed adjacent the outer sides of the parallel rods 46 and thus prevent turning of the guide block about its vertical axis. The upper surface 42 of the guide block 40 is biased continually toward engagement with the support rods by means of helical spring 52 which acts between the upper surface 25 of the support member 28 and the under surface 54 of the guide block 40.

The square passage 38 in the guide block 40 is sized to provide a snug sliding fit with the square outer periphery of the shaft 30. The shaft is therefore guided for axial movement (in a direction which is normal to the surface of the belts 12 and normal to the upper surface 25 of the support member 28) but is constrained against lateral or swinging movement relative to its central axis 58.

A rotatable thumb screw 60 is disposed adjacent the upper surfaces of the fixed support rods 46. The head of the thumb screw 60 is provided on its under surface with a bearing boss 62 for contact with the upper surfaces of rods 46 or in lieu thereof, if desired, a nylon washer may be placed between the head of the thumb screw 60 and the rods 46. The thumb screw 60 includes an axially extending threaded portion 64 integral therewith, and which extends between the rods 46 and which engages the threaded bore 32 in the post 30. The thumb screw rotates about the central axis 58 of post 30. Rotation of the thumb screw in one direction moves the post 30 in a first axial direction. Rotation of the thumb screw in the opposite direction about axis 58 moves the post 30 in the opposite axial direction.

The guide block 40 can be slidably positioned along the support or guide rods 46 in order to adjust the position of the entire pressure roll assembly relative to the conveyor belt.

It has been found that the pressure roll assembly described above is capable of providing extremely fine adjustment of the pressure in the nip between the pressure roll and the conveyor. It has also been found in practice that the desired minimum pressure setting for effective feeding action is such that the full weight of the roll is not applied to the sheet material articles, and such that when the pressure is properly adjusted, the roll applies a very light pressure to the sheet material articles. This pressure setting would be the most advantageous to reduce the likelihood of tracking where freshly printed sheets are fed in a "face up" condition. By means of the pressure roll assembly construction described above, the rotation of the thumb screw provides very fine and precise adjustment of the pressure of the roll on the stock, to accommodate varying conditions such as "face up" fed stock, or to accommodate varying thickness stock.

The screw thread arrangement is easily manipulated via the head of thumb screw 60, and itself contributes to a refined adjustment, but the real sensitivity of adjustment capability results from the cantilever leaf spring in combination with the screw adjustment acting at the base end of the cantilever.

In one example of the preferred arrangement the thumb screw is pitched to provide about 0.036 inches (0.9 mm) per turn, and the leaf spring is calibrated to provide a change in pressure of about 37 grams per turn of the screw. Thus, if we assume that about ⅛ turn of the screw is an amount that is readily distinguishable by touch, different pressure settings whose difference is no more than about 5 grams can be made very easily and very accurately, and with care a change of one or two grams in loading can be readily achieved.

In practice it is found that, with sheets of average weight, the pressure setting of the thumb screw 60 which will give minimum pressure but also insure precise sheet advancement will be less than one turn from the contact zero pressure condition, perhaps exerting a force between 15 and 25 grams. This loading is substantially in excess of that normally provided by the device shown in U.S. Pat. No. 3,741,536 which normally uses balls of about 10 grams, but in spite of this, the tracking tendency is found to be significantly less.

In addition to the delicacy of the adjustment obtainable, the parts are so arranged that the operator can readily make the adjustment while the machine is running, thereby rendering it possible to visually determine the exact moment when the sheets are being fed with proper precision, thus bringing it readily within the capability of the operator to secure the precise minimum pressure needed under the immediate operating circumstances.

In addition, the mass of the rolls is such, for example about 34 grams each (as compared with the much lighter balls, e.g. 10 grams, normally used with a ball support as shown in U.S. Pat. No. 3,741,536), that their inertia minimizes the bounce aspect and provides more reliable feeding when thicker sheets are being dealt with. This extra mass, of course, places no restriction on the minimum feed pressure obtainable since, through the screw and leaf spring system described, it is possible to reduce the feed pressure slowly and in a substantially linear fashion to zero.

As a practical illustration it has been found that on a conventional register board of a lithographic duplicator, the best setting that an opeator can make using the device of U.S. Pat. No. 3,741,536 will result in about 4 percent of the sheets being slightly misregistered, whereas, when using the device shown in the present description, even where adjustment is made as light as possible to give minimum pressure and improved freedom from tracking, it is still possible to achieve a condition wherein no more than about 0.5% of the sheets fail to register properly.

Thus, by means of the foregoing detailed description applicant has described what is believed to be a new and improved pressure roll assembly for use with sheet conveying equipment. With the foregoing discosure in mind, it is believed that many and various obvious modifications of the principles of this invention will become apparent to those of ordinary skill in the art.

What is claimed is:

1. For use with a conveyor having movable surface means for engaging and moving sheet material articles, apparatus for applying pressure to sheet material articles being moved by the conveyor for holding the sheet material articles against the conveyor, said apparatus comprising a pressure roll forming a nip with the moving surface means of the conveyor, a leaf spring having a first end connected with said pressure roll and including means for supporting said pressure roll for rotation about a central axis thereof, a support post disposed normal to the longitudinal axis of said leaf spring, means for fixedly connecting a portion of said leaf spring remote from said first end to said support post to extend therefrom in cantilever fashion, means for mounting said support post including guide means for guiding said support post for axial movement and for restraining movement of said support post in directions transverse to its central axis, and means for adjusting the axial position of said support post for adjusting the pressure on a sheet material article in the nip between said pressure roll and the moving surface means, said means for adjusting the axial position of said support post comprises a rotatable member concentric with the axis of said support post and including a threaded member integral therewith, and further comprising at least one fixed support disposed in spaced relation to the movable conveyor surface means, said guide means comprising a guide block, means for biasing said guide block into engagement with said fixed support, said guide block including a bore and said support post extending through said bore, said bore defining means for guiding said support post for axial movement and for restraining movement thereof in directions transverse to its axis, said support post including an axially extending threaded bore receiving said threaded member of said rotatable member whereby rotation of said rotatable member moves said support post axially, and wherein said means for connecting said leaf spring to said support post includes a support member affixed to said support post and wherein said support member includes a substantially flat surface portion, said leaf spring comprising a substantially flat longitudinally extending planar member, one longitudinal end portion of said leaf spring being fixedly connected with said surface portion of said support member, said means for biasing said guide block against said fixed support comprising spring means acting between said guide block and said flat surface portion of said support member.

2. Apparatus as defined in claim 1 wherein said pressure roll has a cylindrical knurled outer surface.

* * * * *